US007269983B1

(12) United States Patent
Mchatet

(10) Patent No.: US 7,269,983 B1
(45) Date of Patent: Sep. 18, 2007

(54) LOCK ASSEMBLY

(75) Inventor: Hamid Mchatet, Miramar, FL (US)

(73) Assignee: Cellular Masters, Inc., Miami, FL (US)

( * ) Notice: Subject to any disclaimer, the term of this patent is extended or adjusted under 35 U.S.C. 154(b) by 0 days.

(21) Appl. No.: 11/534,879

(22) Filed: Sep. 25, 2006

(51) Int. Cl.
*E05B 73/00* (2006.01)
*E05B 65/00* (2006.01)

(52) U.S. Cl. ..... 70/14; 70/57.1

(58) Field of Classification Search ..... 70/57.1, 70/57, 58, 14, 62, 34, 46, 52; 248/220.42, 248/220.41, 553; 211/7, 59.1
See application file for complete search history.

(56) References Cited

U.S. PATENT DOCUMENTS 5,259,220 A * 11/1993 Fredrickson ..... 70/14
5,275,027 A * 1/1994 Eklof et al. ..... 70/14
5,438,738 A * 8/1995 Stolz et al. ..... 24/704.1
5,485,929 A * 1/1996 Danon ..... 211/57.1
6,279,256 B1 * 8/2001 Norolof et al. ..... 40/642.01
6,659,291 B2 * 12/2003 Huehner et al. ..... 211/4
2001/0013567 A1 * 8/2001 Valiulis ..... 248/220.41

* cited by examiner

*Primary Examiner*—Jennifer H. Gay
*Assistant Examiner*—Alyson Merlino
(74) *Attorney, Agent, or Firm*—Albert Bordas, P.A.

(57) ABSTRACT

A lock assembly including a lock, a key and a rail assembly. The lock includes a lock housing and an actuating housing. The lock housing includes a rear notch, an internal notch that houses a spring and a locking tab, and an aperture that houses a second spring. A vertical track member is mounted to the rear notch and it has a vertical cutout. The actuating housing includes rear, lateral and top walls and a protrusion with a notch. The actuating housing is slidably mounted to the lock housing with a pin. The rail assembly is mounted to racks in stores wherein products for display are mounted thereto. The lock mounts onto the rail assembly by inserting the transversal member of the rail behind the protrusion and pressing the actuating housing against the lock housing until the locking tab engage into the notch.

8 Claims, 6 Drawing Sheets

LOCK ASSEMBLY

BACKGROUND OF THE INVENTION

1. Field of the Invention

The present invention relates to a lock assembly, and more particularly, to a lock assembly that secures products displayed on a look hoop system to prevent theft and misplacement.

2. Description of the Related Art

Retailers loose more than $33 billion annually due to inventory shrinkage that typically results from theft and misplacement. Reducing inventory shrinkage is an important store management issue that must be addressed to achieve and maintain a successful operation. In an effort to increase owner profits, retailers have a need for an easy, simple, and inexpensive lock assembly to secure products displayed on a look hoop system to help prevent theft and product misplacement.

Several lock assemblies have been developed in the past. None of them, however, comprise a lock, key, and rail assembly for securing products displayed on a look hoop system.

SUMMARY OF THE INVENTION

A lock assembly that comprises a lock having a lock housing and an actuating housing. The lock housing comprises a keyhole for a key to unlock the actuating housing from the lock housing. A rail assembly includes two rail members kept at a spaced apart relationship with respect to each other by a transversal member. Locking means are used for securing products suspended from the rail members that protrude from a display assembly. The locking means include mounting the lock onto the transversal member and placing a predetermined force upon the actuating housing towards the lock housing. The actuating housing is slidably mounted onto the lock housing.

The lock housing further comprises first, second, third, fourth and fifth walls. The first wall includes the keyhole, and the second and third walls are parallel and equally spaced apart by the fourth wall. The lock housing further comprises first and second notches. The first notch is disposed with the fifth wall and the second notch is internally disposed next to the second wall. The second notch houses a first spring and a locking tab. The lock housing further comprises an aperture next to the second wall that houses a second spring that has a resilient force. The first notch has a vertical track member mounted thereto at a parallel relationship with respect to the first wall. The vertical track member has means to keep the first wall attached to the lock housing. The vertical track member further has a transversally disposed vertical cutout.

The actuating housing comprises sixth, seventh, eighth and ninth walls, a protrusion with a third notch and a pin. The sixth wall is a rear wall and the seventh and eighth walls are parallel and equally spaced apart by the ninth wall. The protrusion has a cooperative shape and dimension to snugly fit within the first notch. The pin passes through the seventh wall, the vertical cutout and the eighth wall. The second spring keeps the lock unlocked. When locking the lock, the protrusion snugly fits within the first notch and the locking tab is cammingly engaged into the third notch when a user exerts the predetermined force upon the actuating housing towards the lock housing to overcome the resilient force of the second spring. More specifically, the lock is mounted onto the rail assembly by inserting the transversal member behind the protrusion and the predetermined force is placed upon the actuating housing towards the lock housing until the locking tab is engaged into the third notch. The key actuates the locking tab to release the locking tab from the third notch.

The display assembly is a look hoop system comprising holes to receive distal ends of the rail members. The rail members have curvature between the transversal member and the distal ends to secure the rail assembly into the holes of the look hoop system. In the preferred embodiment, the rail members are parallel.

It is one of the main objects of the present invention to provide a lock assembly that can be readily mounted and unmounted without tools.

It is another object of the present invention to provide a lock assembly that minimizes locking and unlocking time.

It is another object of the present invention to provide a lock assembly that is volumetrically efficient for transportation and storage.

It is yet another object of this invention to provide such a lock assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
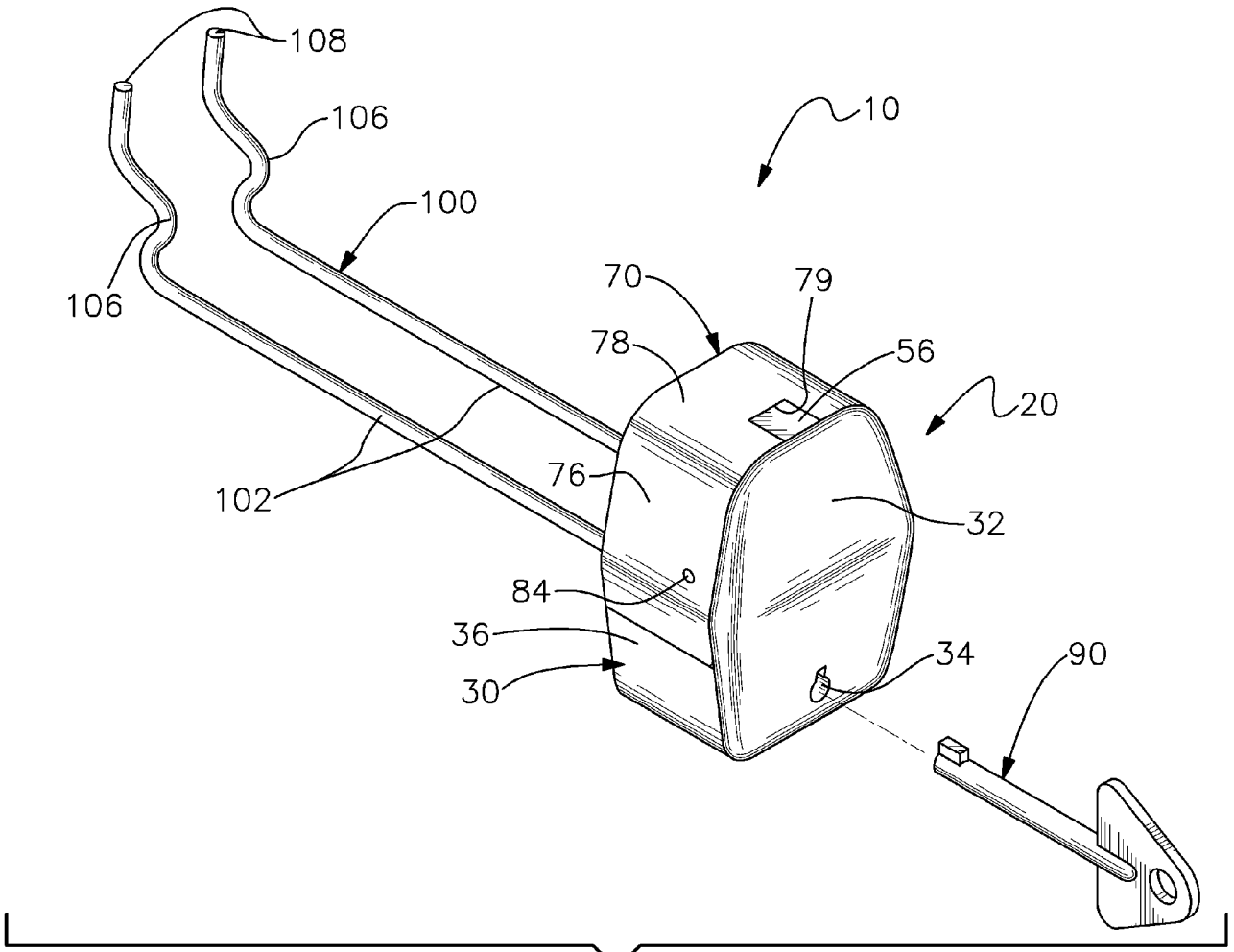
FIG. 1 represents an isometric view of the lock assembly, object of the present invention, in a locked position.

Referring now to the drawings, where the lock assembly is generally referred to with numeral 10, it can be observed that it basically includes lock 20, key 90 and rail assembly 100.

As seen in FIG. 1, lock assembly 10 comprises lock 20, key 90 and rail assembly 100. Lock 20 mounts onto rail assembly 100 and may be locked. Key 90 is used to unlock lock 20 from rail assembly 100. A plurality of rail assemblies 100 are usually mounted to display racks in stores, not seen. Products, not seen, typically suspend from rail members 102, and more specifically suspend between curvatures 106 and lock 20. As seen in this illustration, lock 20 comprises lock housing 30 and actuating housing 70. Lock housing 30 has front wall 32, lateral walls 36 and 38, bottom wall 40, and rear wall 42, seen in FIGS. 3 and 4. Front wall 32 has keyhole 34 to receive key 90.

Figure 2:
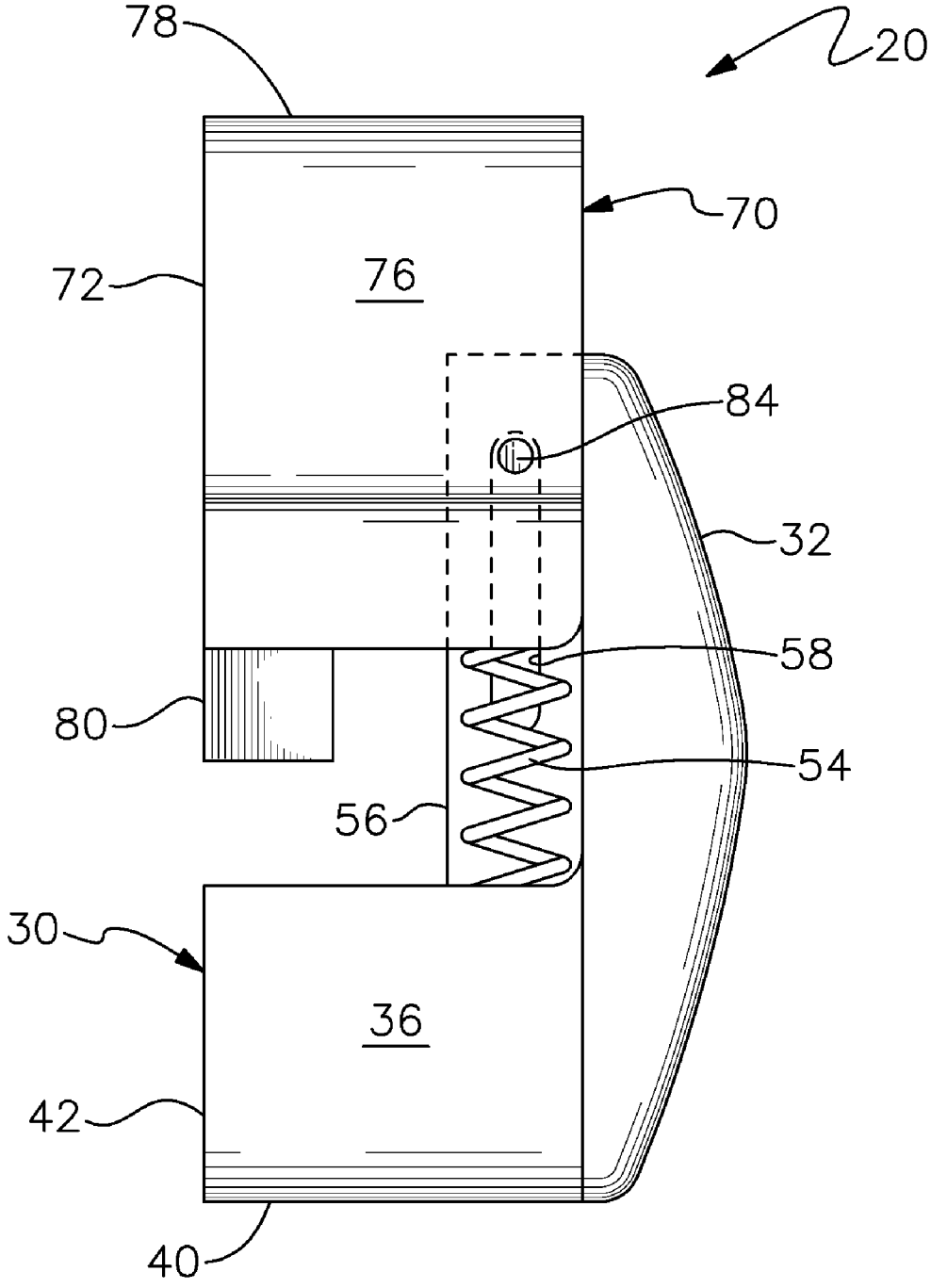
FIG. 2 shows a side elevational view of the lock in an unlocked position.
Figure 3:
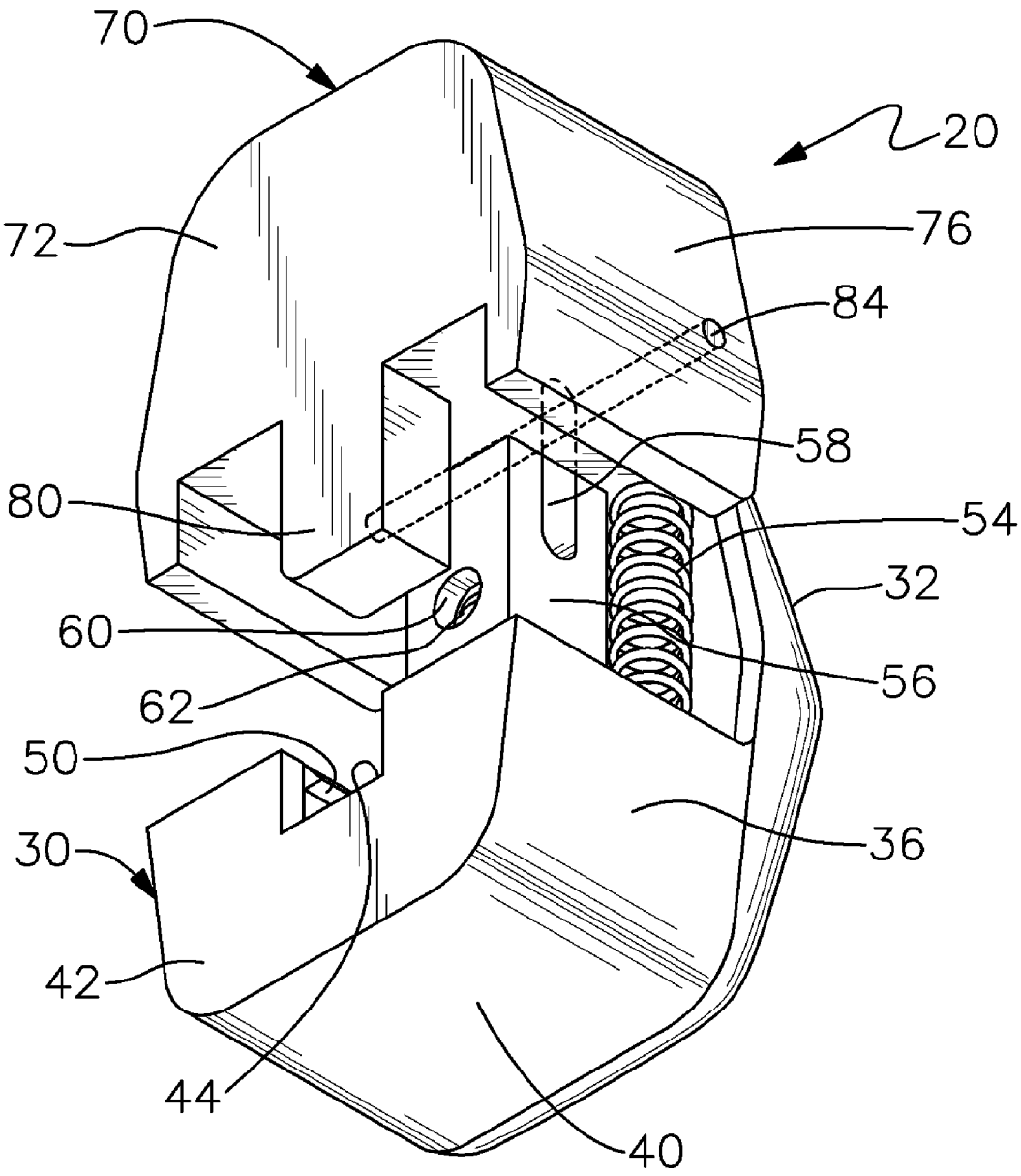
FIG. 3 illustrates a first rear isometric view of the lock represented in FIG. 2.
Figure 4:
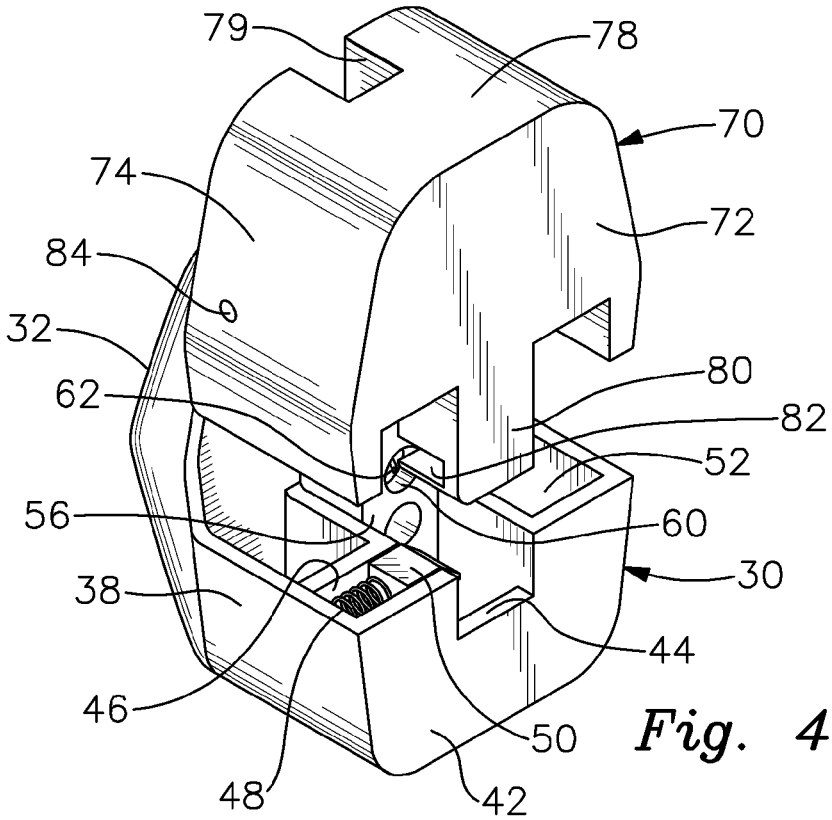
FIG. 4 illustrates a second rear isometric view of the lock represented in FIG. 2, as seen from an opposite angle to that shown in FIG. 3.

As seen in FIGS. 2, 3, and 4, lock housing 30 comprises lateral walls 36 and 38 that are substantially parallel and equally spaced apart by bottom wall 40.

Lock housing 30 also includes rear notch 44. Notch 46 is internally disposed next to lateral wall 38. Notch 46 houses spring 48 with locking tab 50. On an opposite side and next to lateral wall 36, aperture 52 houses spring 54. Vertical track member 56 is mounted to rear notch 44 at a parallel relationship with respect to front wall 32. Vertical track member 56 has hole 60 with screw 62, as means to keep front wall 32 attached to lock housing 30. Vertical track member 56 also has vertical cutout 58 transversally disposed at its upper portion.

Actuating housing 70 includes rear wall 72, lateral walls 74 and 76, top wall 78, protrusion 80 with notch 82, and pin 84. Lateral walls 74 and 76 are kept parallel and equally spaced apart by top wall 78. Top wall 78 comprises channel 79 to allow vertical track member 56 to slidably journal therethrough. Protrusion 80 has a cooperative shape and dimension to snugly fit within rear notch 44. In the preferred embodiment, actuating housing 70 is slidably mounted to lock housing 30 with pin 84, which passes through lateral wall 74, vertical cutout 58 and lateral wall 76. Spring 54 keeps lock 20 unlocked, as best seen in FIG. 2. When a user exerts a sufficient force to overcome the resilient force of spring 54, protrusion 80 slides into rear notch 44 and locking tab 50 cammingly engages into notch 82 to achieve the locked position. To unlock, key 90 is inserted into keyhole 34 and when turned, actuates locking tab 50 to release protrusion 80 from rear notch 44.

Figure 5:
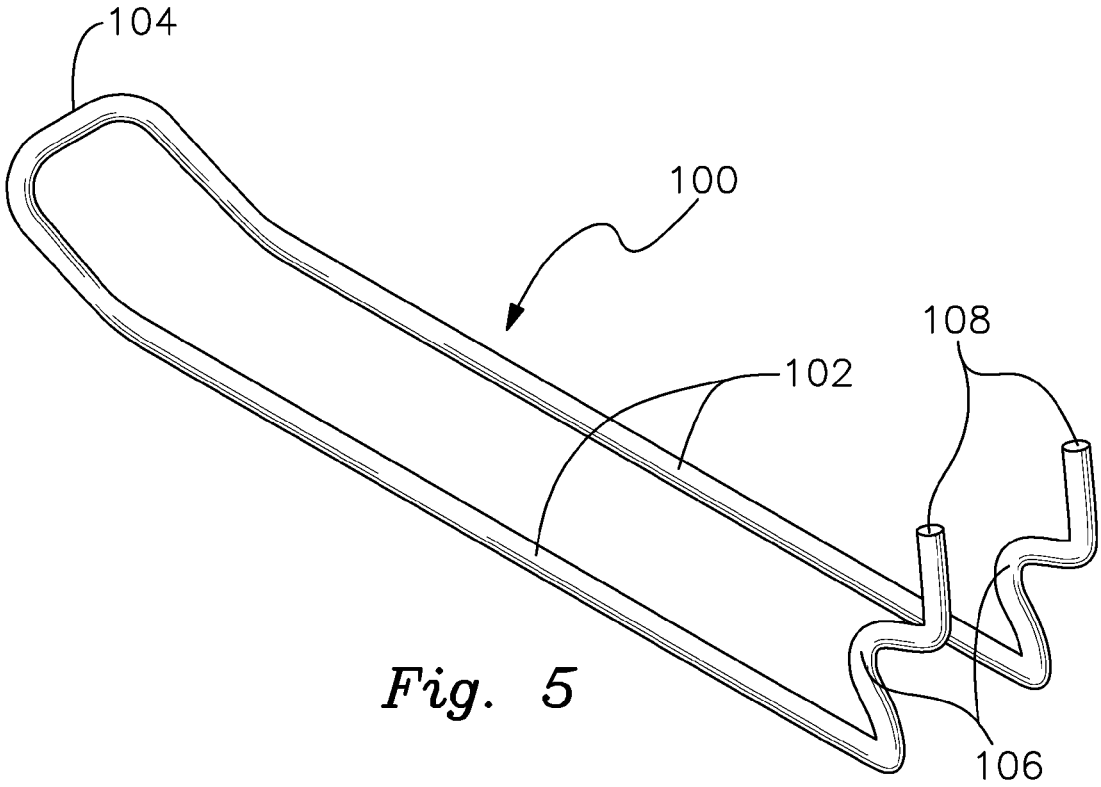
FIG. 5 is an isometric view of the rail assembly.

As best seen in FIG. 5, rail assembly 100 includes rail members 102 kept at a parallel and spaced apart relationship with respect to each other by transversal member 104. Rail members 102 have curvatures 106 next to distal ends 108.

Figure 6:
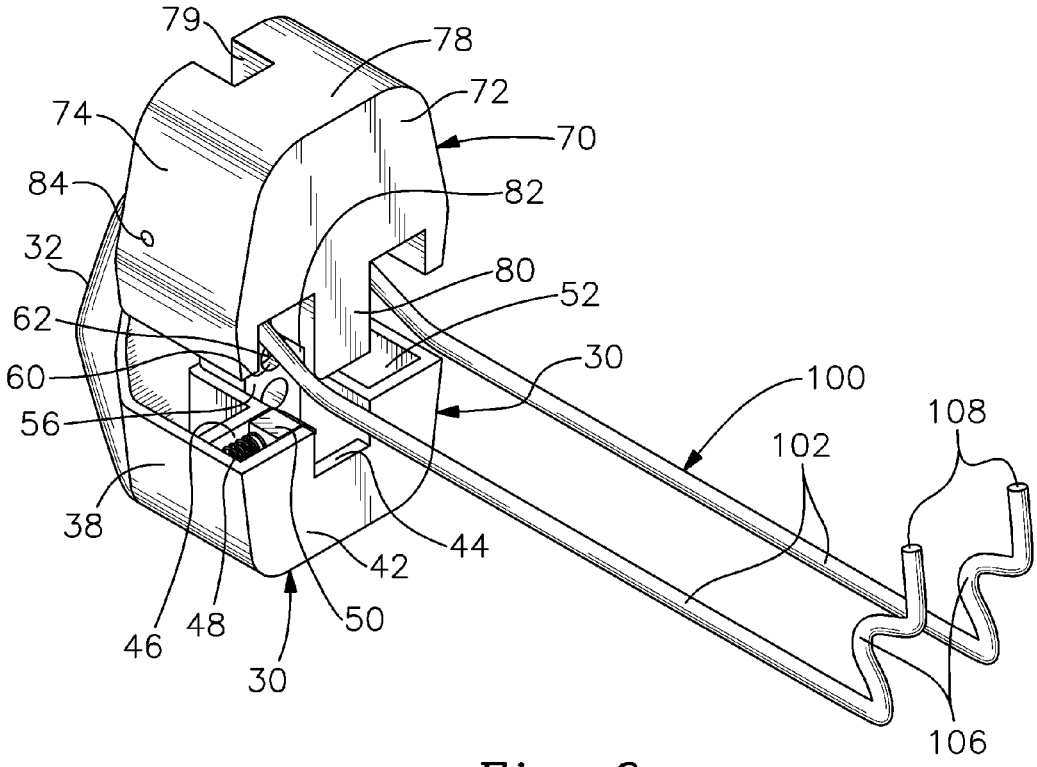
FIG. 6 shows an isometric view of the lock mounted onto the rail assembly in an unlocked position.
Figure 7:
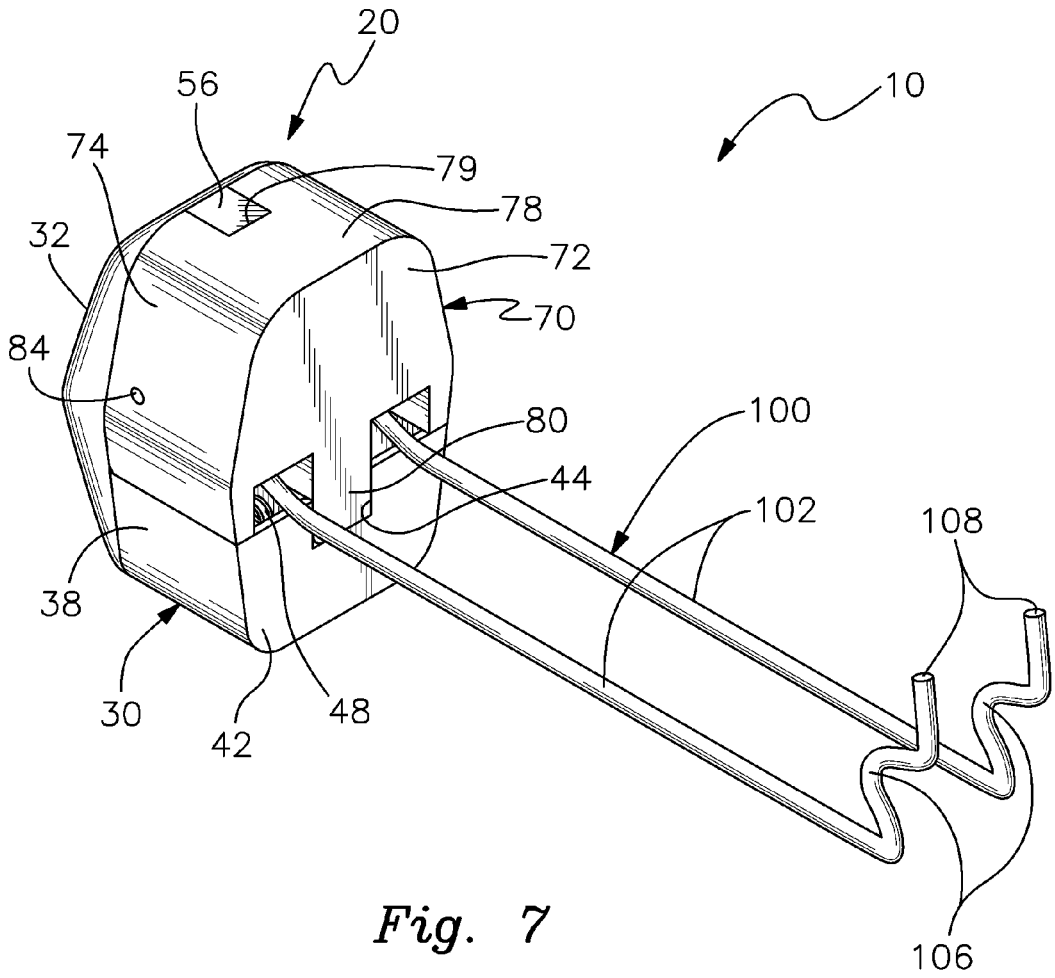
FIG. 7 shows an isometric view of the lock mounted onto the rail assembly in a locked position.

In operation, distal ends 108 are inserted through holes of a look hoop system, not seen, and curvatures 106 hold them in place. Products are then slid over transversal member 104 and are slid upon rail members 102 in the direction of curvatures 106. When the desired number of products is suspended, as locking means, lock 20 is mounted onto transversal member 104 and a predetermined force is placed upon actuating housing 70 towards lock housing 30. More specifically, lock 20 is mounted onto rail assembly 100 by inserting transversal member 104 behind protrusion 80. The predetermined force is then placed upon actuating housing 70 towards lock housing 30 until locking tab 50 engages into notch 82, as seen in FIGS. 6 and 7.

In an alternate embodiment, rail assembly 100 may extend from a freestanding display rack, or other display assembly having an elongated rail assembly member from which products may hang therefrom.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lock assembly, comprising:

A) a lock having a lock housing and an actuating housing, said lock housing comprising a keyhole for a key to unlock said actuating housing from said lock housing, said actuating housing is slidably mounted onto said lock housing, said lock housing further comprising first, second, third, fourth and fifth walls, said first wall including said keyhole, said second and third walls being parallel and equally spaced apart by said fourth wall, said lock housing further comprising first and second notches, said first notch being disposed with said fifth wall and said second notch being internally disposed next to said second wall, said second notch housing a first spring and a locking tab, and said lock housing further comprising an aperture next to said second wall that houses a second spring having a resilient force, said first notch having a vertical track member mounted thereto at a parallel relationship with respect to said first wall, said vertical track member having means to keep said first wall attached to said lock housing, said vertical track member further having a transversally disposed vertical cutout; and B) a rail assembly including two rail members kept at a spaced apart relationship with respect to each other by a transversal member.

2. The lock assembly set forth in claim 1, wherein said actuating housing comprises sixth, seventh, eighth and ninth walls, a protrusion with a third notch and a pin, said sixth wall being a rear wall and said seventh and eighth walls being parallel and equally spaced apart by said ninth wall, said protrusion having a cooperative shape and dimension to snugly fit within said first notch.

3. The lock assembly set forth in claim 2, wherein said pin passes through said seventh wall, said vertical cutout and said eighth wall and wherein said second spring keeps said lock unlocked, said protrusion is snugly fitted within said first notch and said locking tab is cammingly engaged into said third notch when a user exerts said predetermined force upon said actuating housing towards said lock housing to overcome the resilient force of said second spring.

4. The lock assembly set forth in claim 3, wherein said lock is mounted onto said rail assembly by inserting said transversal member behind said protrusion and said predetermined force is placed upon said actuating housing towards said lock housing until said locking tab is engaged into said third notch.

5. The lock assembly set forth in claim 4, wherein said key actuates said locking tab to release said locking tab from said third notch.

6. The lock assembly set forth in claim 5, wherein said display assembly is a look hoop system comprising holes to receive distal ends of said rail members.

7. The lock assembly set forth in claim 6, wherein said rail members have curvature between said transversal member and said distal ends to secure said rail assembly into said holes of said look hoop system.

8. The lock assembly set forth in claim 7, wherein said rail members are parallel.

* * * * *